US005309210A

United States Patent [19]

Yamamoto et al.

[11] Patent Number: 5,309,210

[45] Date of Patent: May 3, 1994

[54] IMAGE FIXING APPARATUS USING FIXING FILM CONTAINING FLUORINATED RESIN

[75] Inventors: Akira Yamamoto, Tokyo; Shigeo Kimura, Yokohama; Kensaku Kusaka, Kawasaki; Hidekazu Muruta, Hachioji; Hiroyuki Adachi, Tokyo, all of Japan

[73] Assignee: Canon Kabushiki Kaisha, Tokyo, Japan

[21] Appl. No.: 884,997

[22] Filed: May 18, 1992

Related U.S. Application Data

[63] Continuation of Ser. No. 542,067, Jun. 22, 1990, abandoned.

[30] Foreign Application Priority Data

Jun. 22, 1989 [JP] Japan ..... 1-161391

[51] Int. Cl.[5] ..... G03G 15/20

[52] U.S. Cl. ..... 355/285; 219/216; 355/290

[58] Field of Search ..... 355/282, 284, 285, 286, 355/289, 290; 219/216, 388, 469-471; 432/59, 60; 118/60

[56] References Cited

U.S. PATENT DOCUMENTS

| | | | |
|---|---|---|---|
| 3,578,797 | 5/1991 | Hodges | 219/388 X |
| 3,810,735 | 5/1974 | Moser | 432/59 |
| 3,811,828 | 5/1974 | Ohta et al. | 219/216 X |
| 4,386,838 | 6/1983 | Hirabayashi et al. | 355/200 |
| 4,565,439 | 1/1986 | Reynolds | 355/290 |
| 4,566,779 | 1/1986 | Coli et al. | 355/212 |
| 4,924,267 | 5/1990 | Yoshikawa et al. | 355/210 |
| 4,954,845 | 9/1990 | Yano et al. | 355/290 |

FOREIGN PATENT DOCUMENTS

| | | | |
|---|---|---|---|
| 0295901 | 12/1988 | European Pat. Off. | 355/284 |
| 63-56662 | 3/1988 | Japan | 355/290 |
| 63-313182 | 12/1988 | Japan . | |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

An image fixing apparatus includes a heater; a film movable with a recording material, wherein the recording material have a visualized image which is heated through the film by heat from the heater; wherein the film includes a heat resistive resin base layer containing fluorine resin. The resin base layer having at least one of polyimide, polyether ether ketone, polyether sulfon, and polyether imide resin material.

17 Claims, 5 Drawing Sheets

IMAGE FIXING APPARATUS USING FIXING FILM CONTAINING FLUORINATED RESIN

This application is a continuation of application Ser. No. 07/542,067 filed June 22, 1990, now abandoned.

FIELD OF THE INVENTION AND RELATED ART

The present invention relates to an image fixing apparatus for heat-fixing a visualized image through a film, and to an image fixing apparatus for fixing an unfixed toner image or for re-fixing an image for improvement of the surface property of the image.

In a widely used conventional image fixing apparatus usable with an image forming apparatus such as an electrophotographic machine wherein the toner image is fixed on the recording medium supporting an unfixed toner image, the recording material is passed through a nip formed between a heating roller maintained at a predetermined temperature and a pressing or back-up roller having an elastic layer and press-contacted to the heating roller.

The heat roller type fixing system requires that the surface temperature of the heating roller is maintained at a proper temperature level in order to prevent the high temperature off-set and the low temperature off-set with the result that the large thermal capacity of the heat roller is required. This necessitates the long image formation prohibited period (waiting period) until the large thermal capacity heat roller reaches a predetermined surface temperature level.

U.S. Pat. No. 3,578,797 proposes an apparatus wherein the toner image is heated and fused through a belt.

As shown in U.S. Pat. No. 3,578,797, a belt type image fixing apparatus is known. In this system, (1) the toner image is contacted to a heater web and is heated to the fusing point temperature, and therefore, is fused; (2) the toner is cooled and solidified to have a high viscosity; and (3) the adherence of the toner is weakened, and then it is separated from the heater web. By doing so, the toner image is fixed without production of toner off-set. With this belt type fixing system, the tolerable range for the toner heating temperature is wide, and the waiting period can be reduced.

In this fixing apparatus, the sufficient heat can be supplied to the toner, and the tolerable range of the temperature is enlarged.

In order to solve this problem, U.S. Ser. Nos. 206,767, 409,431, 426,082, 435,427, 440,380, 496,957, and U.S. Pat. Nos. 4,954,845, 4,998,121, 5,026,276, 5,225,874, 4,262,834, 5,262,834, 5,027,160 and 5,179,263, proposes an image fixing apparatus having a fixed heater and a heat-resistive fixing film in a sliding contact with the heater, wherein the toner image is fused through the film.

In the belt fixing system or a film heating system, the belt or the film is gradually shifted in the direction perpendicular to its movement direction (lateral direction) when it is used for a long period of time, due to inaccuracy in the directions of the belt driving roller or the driven roller, due to diameter changes by thermal expansion, or due to the change in the friction force between the heater and the film. In order to correct the lateral shifting, U.S. Pat. No. 4,565,439 proposes a lateral shift control system.

However, even with this system, the lateral shift control is obstructed, or the film is creased during the lateral shift control operation, due to the close-contactness and the friction resistance between the inside surface of the film and a member or members contacted to the inside surface such as the driving roller.

In the film fixing system wherein the heater and the film for sliding contact therewith are used, the sliding contact between the heater and the film produces a significant noise, as the case may be.

SUMMARY OF THE INVENTION

Accordingly, it is a principal object of the present invention to provide an image fixing apparatus in which the film can be smoothly driven.

It is another object of the present invention to provide an image fixing apparatus wherein the sliding noise between the film and the heater are suppressed.

It is a further object of the present invention to provide an image fixing apparatus using a film containing fluorinated resin.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The embodiments of the present invention will be described in conjunction with the accompanying drawings.

Figure 4:
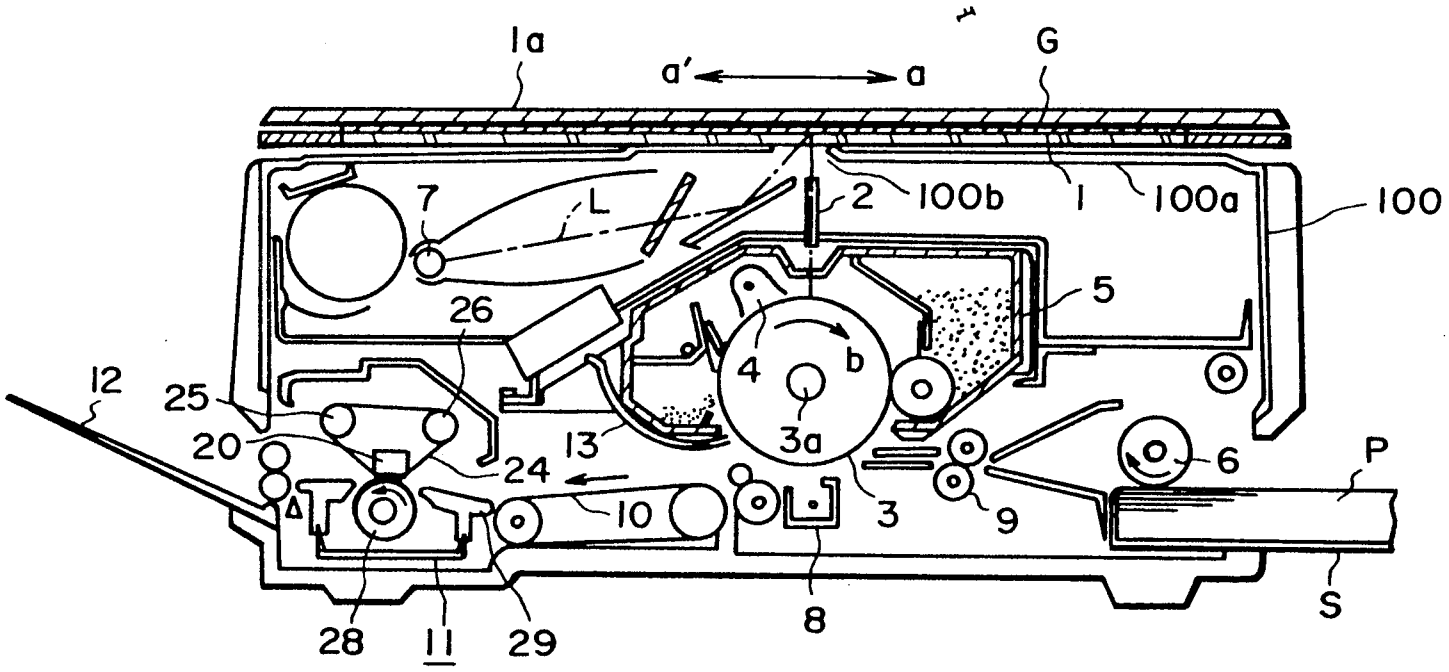
FIG. 4 is a sectional view of an image forming apparatus containing the image fixing apparatus shown in FIG. 1.

Referring first to FIG. 4, there is shown an image forming apparatus of an electrophotographic type using an image fixing apparatus according to an embodiment of the present invention.

The apparatus comprises a housing 100, a reciprocable original supporting platen 1 made of transparent member such as glass plate disposed on the top plate 100*a* of the housing 100, wherein the original supporting platen 1 is reciprocable rightwardly (a) and leftwardly (a') on the top plate 100*a* at predetermined speeds.

An original G is placed face down on the original supporting platen 1 at a predetermined placing reference, and is covered by an original cover 1*a*.

A slit opening 100*b* is formed on the top plate 100*a* extending in a direction perpendicular to the reciprocable movement direction of the original supporting platen (perpendicular to the sheet of the drawing). The slit constitute a part of the original illuminating system. The face-down image surface of the original G placed on the original supporting platen 1 passes by the slid opening 100*b* during the movement of the original supporting platen 1 toward the right side (a). During the passage, the light L of the lamp 7 illuminates the original G through the slit opening 100*b* and the transparent original supporting platen 1. The light reflected by the original is imaged on the surface of the photosensitive drum 3 through an array 2 of imaging elements having a short focus and a small diameter.

The photosensitive drum 3 is coated with a photosensitive layer such as zinc oxide photosensitive layer or an organic photoconductor photosensitive layer. It is rotatable about a central axis 3*a* at a predetermined peripheral speed in the clockwise direction (b). During the rotation, the photosensitive drum 3 is uniformly charged to a positive or negative polarity by a charger 4, and the uniformly charged surface is exposed to the image light of the original through the slit opening, so that an electrostatic latent image corresponding to the light image is sequentially formed on the surface of the photosensitive drum 3.

The electrostatic latent image is visualized into a toner image with heat-softening or -fusing resin or the like (toner powder) by the developing device 5, and the visualized toner image is conveyed to the image transfer station having the transfer discharger 8.

The transfer material sheets P are contained in a cassette S. The sheet is singled out from the cassette by rotation of a pick-up roller 6 and is fed to the photosensitive drum 3 in such a timed relationship that when the leading of the toner image formed portion on the drum 3 reaches the transfer discharger 8, the leading edge of the transfer sheet P reaches the position between the transfer discharger 8 and the photosensitive drum 3. By the transfer discharger 8, the toner image is sequentially transferred onto the fed sheet from the photosensitive drum 3.

The sheet having received the toner image is sequentially separated from the surface of the photosensitive drum 3 by an unshown separating means and is introduced by conveying device 10 to an image fixing apparatus 11, where the unfixed toner image is heat-fixed. Thereafter, it is discharged onto the discharge tray outside the apparatus as a final print (copy) by a guide 35 and discharging rollers 36.

On the other hand, the surface of the photosensitive drum 3 having been subjected to the toner image transfer operation is cleaned by the cleaning device 13 so that the residual toner or other contamination are removed to be prepared for the next image forming operation.

Figure 1:
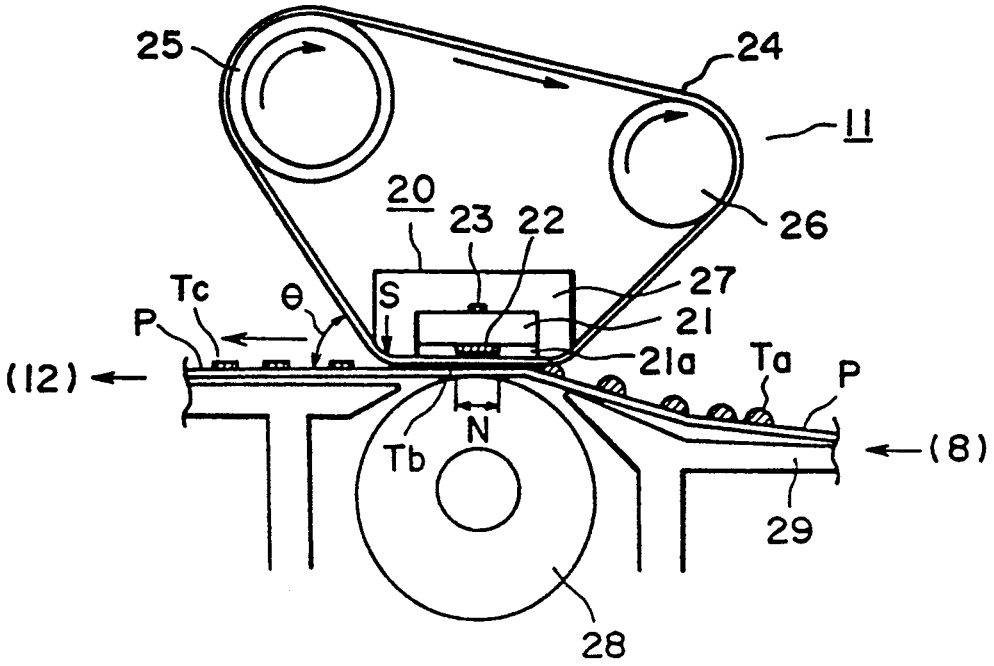
FIG. 1 is a sectional view of an image fixing apparatus according to an embodiment of the present invention.

Referring now to FIG. 1, the image fixing apparatus 11 according to an embodiment of the present invention will be described.

An image fixing film 24 is in the form of an endless belt, and is stretched around parallel four members, i.e., a driving roller (left side) 25, a driven roller (right side) 26, a linear heater which has a low thermal capacity and which is disposed at a lower position between said driving roller 25 and the driven roller 26 and a heater supporting member 27.

The driven roller or follower roller 26 functions also as a tension roller for the endless fixing film 24. When the driving roller 25 rotates in the clockwise direction, the fixing film 24 rotates also in the clockwise direction at a predetermined peripheral speed, that is, the same speed as the conveying speed of the transfer sheet P conveyed from the image forming station 8 and carrying thereon an unfixed toner image Ta, without speed difference, without production of crease and without snaking motion.

Although not shown in the FIGURE in order to prevent lateral shifting of the endless fixing film 24 in a long term use, film shift control means (not shown) is provided to change the tension to the fixing film 24 supported on the rollers 25 and 26 and the heater 20 at the longitudinal end or ends of the rollers 25 and 26, or means is provided to change a level or levels of the roller or rollers. Another means is usable for the same purpose.

A pressing roller (pressing member) 28 has a rubber elastic layer made of rubber material having good parting property such as silicone rubber. It is urged, by unshown urging means, toward the bottom surface of the heater 20 with the total pressure of 4–7 Kg with the bottom travel of the fixing film 24 sandwiched therebetween. The pressing roller 28 rotates in the counterclockwise direction, that is, in the same peripheral movement direction as the transfer sheet P.

The heater 20 having the low thermal capacity and having the linear shape, in this embodiment, comprises the heater supporting member 27 extending in the direction of the width of the fixing film 24 (perpendicular to the movement direction of the fixing film 24). The supporting member has sufficient rigidity, heat-resistivity and heat-insulation properties. The heater 20 also comprises a heater base 21 mounted on the bottom surface of the supporting member 27 and extended along the length of the supporting member 27. The heater base is provided with a heat generating element 22 and a temperature detecting element 23.

The heater supporting member 27 functions to support the heater 20 on the fixing apparatus, and therefore, on the image forming apparatus with sufficient thermal insulation. Examples of usable materials for the heater supporting member 27 are high heat-resistivity resins such as PPS (polyphenylenesulfide), PAI (polyimide amide), PI (polyimide), PEEK (polyether ether ketone) or liquid crystal resins, or composites of such a resin and ceramic material, metal, glass or the like.

The heater base 21 has, for example, an alumina plate having a thickness of 1.0 mm, a width of 10 mm and a length of 240 mm. The heat generating element 22 is applied through a screen printing process or the like on the bottom surface of the base 21 along the length thereof. It is made of electric resistance material such as Ag/Pd (silver-palladium), for example, and has a thickness of approx. 10 microns and a width of 1–3 mm. The heat generating element 22 is coated with a heat-resistive glass having a thickness of approx. 10 microns as a surface protection layer.

The temperature sensor 23 is, for example, a temperature detecting element applied through a screen printing process on the top surface (opposite from the surface having the heat generating element 22 at the center thereof. It is made of Pt film or the like having a low thermal capacity. The temperature sensor 23 may be in the form of a thermister having a low thermal capacity contacted to the base 21.

In this embodiment, the linear or strap form heat generating member 22 is connected with electric power at the opposite longitudinal ends, so that the heat is generated over the entire length thereof. The power is AC 100 V in this example. In response to the output of the temperature sensor 23, the power supply to the heat generating member is controlled by changing a phase angle of the electric power supplied from an unshown power supply circuit.

The image fixing operation of the apparatus of this embodiment will be described.

Upon image formation start signal, the image forming apparatus starts to form an image. A visualized toner powder image is formed on the transfer sheet P, and the transfer sheet having the toner image Ta is conveyed from the transfer station 8 to the image fixing apparatus 11. It is introduced along the guide 29 into the nip N formed between the pressing roller 28 and the fixing film 24 urged by the pressing roller toward the heater 20, and is passed through the nip together with the fixing film in contact with the bottom surface of the film without relative movement therebetween and without production of crease.

The heater 20 is energized at predetermined timing from the image formation start signal, so that the toner image Ta is heated at the nip N and is fused into a fused image Tb.

The movement direction of the fixing film 24 abruptly changes by as large as approx. 45 degrees ($=\theta$) at an edge S of the supporting member which has a large curvature (radius of approx. 2 mm). The sheet P which comes through the nip N with the fixing film 24 in contact is separated by the abrupt increase of the curvature from the fixing film 24 at the edge S. It is conveyed to the discharge tray 12. By the time of the sheet P reaching the discharge tray 12, the toner is sufficiently cooled and solidified so as to be completely fixed on the sheet P into the fixed toner image Tc.

The toner used in this embodiment has sufficiently high viscosity when heated and fused to provide far higher adherence among toner particles that the adherence between the toner and the fixing film 24, even if the temperature of the toner at the time of the separation thereof from the fixing film 24 is higher than the melting point of the toner. For this reason, substantially no toner offset occurs to the fixing film 24 when the sheet is separated from the fixing film 24.

In this embodiment, the thermal capacities of the heat generating element 22 and the base 21 of the heater 20 are small, and are supported by the supporting member with the thermal insulation provided by the supporting member 27, so that the surface temperature of the heater 20 at the nip N rapidly raised to a level sufficiently higher than the toner fusing point (or the fixable temperature relative to the sheet P). Therefore, there is no need of stand-by heating to heat the heater beforehand. Accordingly, the energy consumption can be saved, and the temperature rise in the apparatus can be prevented.

Figure 2:
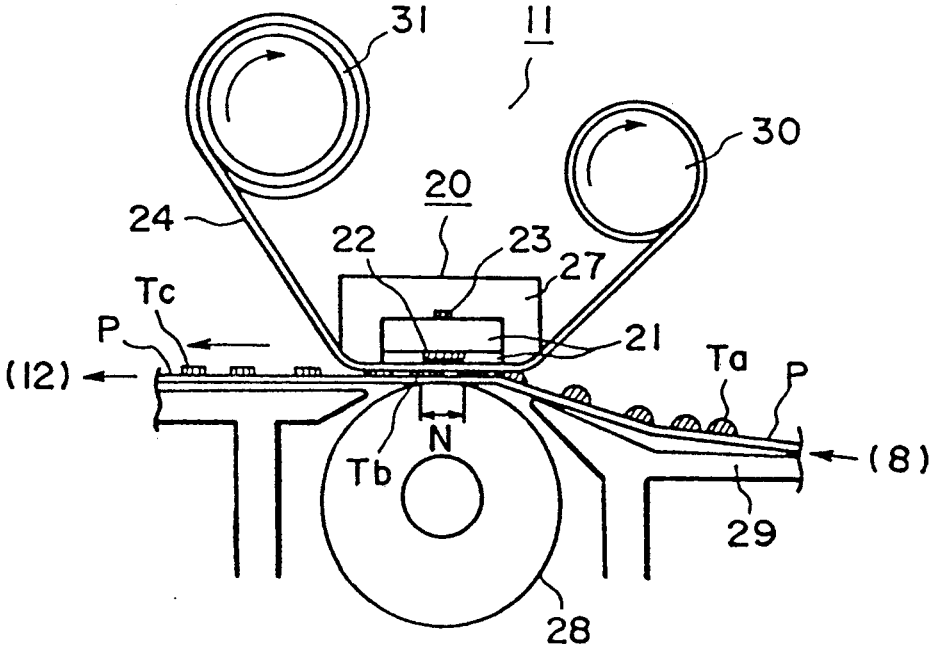
FIG. 2 is a sectional view of an image fixing apparatus using the fixing film in the form of a non-endless film.

The fixing film 24 in not limited to an endless belt, but may be a non-endless belt wrapped on a supply shaft 30 and on a take-up shaft 31 through the nip formed between the heater 20 and the pressing roller 28, as shown in FIG. 2. The film 24 in this form is moved from the supply shaft 30 side to the take-up shaft 31 side at the same speed as the transfer material conveying speed.

The description will be made as to the fixing film 24.

The fixing film 24 contains 0.1-10 % of fluorinated resin particles dispersed. Then, the friction between the film 24 and the heater 20 during the film driving, is decreased, so that the sliding property is significantly improved with the additional result of easy control of the film lateral shifting. When the surface of the film is provided with a parting layer made of fluorine resin, the close-contactness between the film and the parting layer is improved.

Figure 3A:
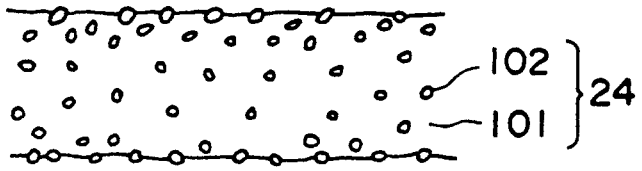
FIGS. 3A and 3B are schematic sectional view illustrating the laminated structure of the film.
Figure 3B:
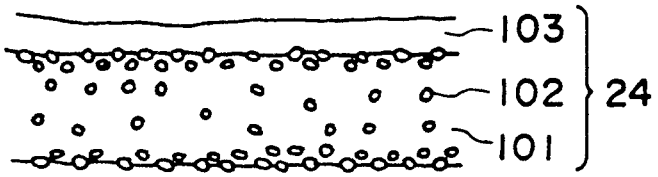

FIGS. 3A and 3B are schematic sectional view illustrating the laminated structures of the films 24.

In FIG. 3A, the heat resistive resin material 101 contains 0.1-10 % of fluorinated resin particles 102. This may be produced by the following process, for example. The fluorinated resin particles, tetrafluoroethylene resin particles (PTFE particles) are dispersed in the precursor of the polyimide. The liquid is applied on a mold, and is heated into imide, and thereafter, it is separated from the mold. In this process, there is a tendency that the PTFE particles 102 are moved to the neighborhood of the surface of the applied liquid during the heat-drying operation, and therefore, a larger amount of PTFE particles 102 are present adjacent to the neighborhood of the film surface.

FIG. 3B shows an example wherein a parting layer 103 made of fluorinated resin or silicone resin material on the side of the film contactable to the recording material.

The endless film of this laminated structure was incorporated in the apparatus 11 in FIG. 1 as the image fixing film 24, and was driven. It was confirmed that the lateral shift control operation was maintained smooth, and the film was not creased, even after a practically long period of operation. In addition, no noise was produced from the sliding contact between the film and the heat generating member.

The total thickness of the fixing film 24 is preferably not more than 100 microns, and further preferably not more than 50 microns. From the standpoint of the stabilized driving, it is preferably not less than 10 microns. The examples of the fixing film 24 are polyether ether ketone (PEEK), polyether sulfone (PES), polyether imide (PEI) or another heat resistive resin. However, from the standpoint of the durability of the film, the polyimide resin is preferable.

The parting layer 103 is not necessary when the toner or the resin on the recording material is separated from the film after the film is sufficiently cooled. However, the provision of the high parting layer of heat resistivity made of fluorinated resin or silicone resin or the like such as PTFE, PFA or FEP material.

The fluorinated resin dispersed in the heat resistive resin such as polyimide is not limited to the PTFE resin, but PFA or FEP resin particles are usable.

When, however, the fluorinated resin is applied on the heat resistive resin base layer as the surface parting layer, it is preferable that the resin material contained in the base layer is the same as the resin in the coating layer.

The content of the fluorinated resin contained in the base layer is 0.1-10 %, preferably 1-5 % since if it is smaller than 1 %, the friction force is not sufficiently lowered, and since if it is larger than 10 %, the strength of the base film is remarkably decreased.

The laminated structure of the heat resistive layer 101, 102 and the parting layer 103 may be provided by bonding the parting layer on the heat resistive layer, by electrostatic printing (coating), evaporation, CVD or another film forming process of the parting layer material, or by simultaneously extruding the heat resistive layer material and the parting layer material.

The surface resistance of the fixing film 24 may be lowered by adding in the parting layer 103 conductive material such as carbon black graphite or conductive whisker materials. By doing so, the charging of the toner contactable surface of the film 24 can be prevented. When the toner contactable side of the fixing film 24 is electrically insulating, the above surface of the fixing film 24 is electrically charged with the possible result that the disturbance to the toner image on the sheet P (recording material) or the possible result of the toner image being transferred onto the fixing film 24 (so-called charge off-set). By the conductive materials, the problems can be avoided.

Figure 5:
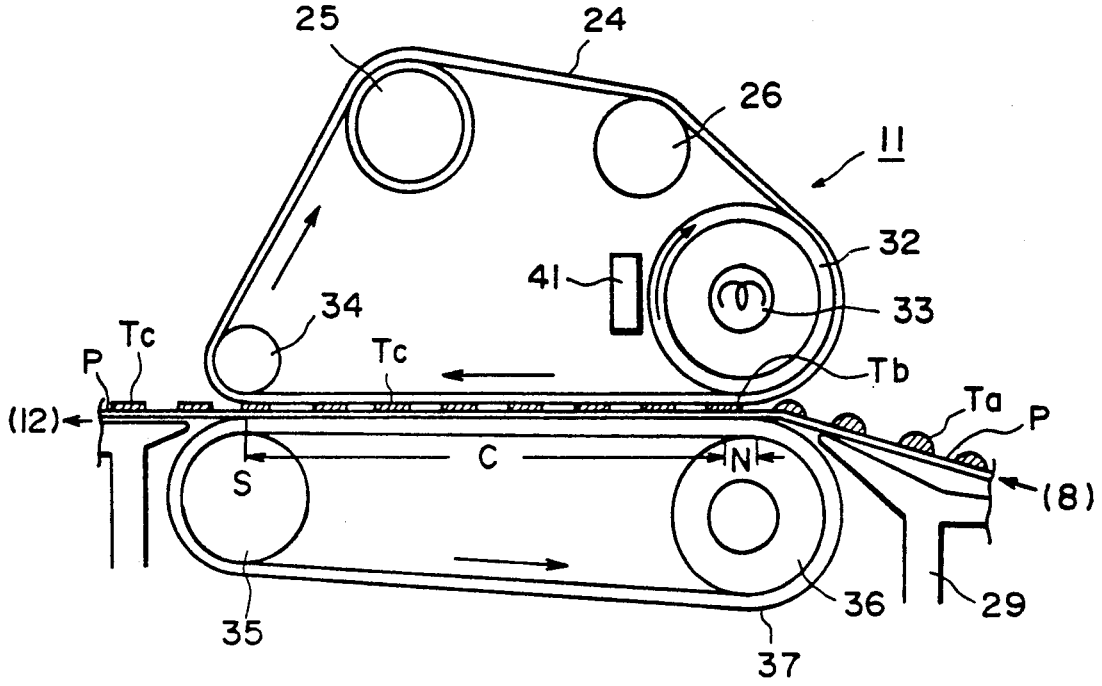
FIGS. 5, 6 and 7 are sectional views of image fixing apparatuses according to further embodiments of the present invention.

FIG. 5 shows an image fixing apparatus according to a further embodiment of the present invention.

The fixing apparatus comprises an upper separation roller 34 having a small diameter and disposed downstream of the a heating roller 32 with respect to the conveyance direction of the sheet P, a driving roller 25 for rotationally traveling the fixing film, and a follower or driven roller 26 for applying proper tension at all times to the fixing film. The driving roller 25 and the driven roller 26 are rotated in the clockwise direction at the same speed as the sheet conveyance speed.

An image fixing film 34 is stretched around four parallel members 32, 34, 25 and 26.

The apparatus further comprises a pressing roller 36 disposed below the heating roller 32, a lower separation roller 35 disposed below a the upper roller 34, a conveyer belt (back-up belt) 37 in the form of an endless belt stretched around the pressing roller 36 and the lower separation roller 35. The pressing roller 36 has a surface layer made of elastic material such as silicone rubber. Between the pressing roller 36 and the heating roller 32, the bottom travel of the endless fixing film 24 is sandwiched, and the total pressure of 4–7 kg is applied by an unshown urging means.

When the heating roller 32 is rotationally driven, the pressing roller 36 rotates, by which the conveyer belt 37 rotates in the counterclockwise direction at the same speed as the sheet conveyance speed, while press-contacting the sheet P to the fixing film 34.

In operation, upon image formation start signal, the image forming apparatus starts to form an image. A visualized unfixed toner image is formed on the transfer sheet P, and thereafter the transfer sheet having the toner image Ta is conveyed from the transfer station 8 to the image fixing apparatus 11. It is introduced along the guide 29, while the fixing film 24 and the conveyer belt 37 are rotated, into the nip N formed between the pressing roller 28 and the fixing film 24 urged by the pressing roller toward the heating roller 32, and is passed through the nip together with the fixing film in contact with the bottom surface of the film without relative movement therebetween and without production of crease.

During the passage through the nip N, the toner image Ta is heated and is fused into a fused image Tb.

The portion of the sheet having passed through the nip N between the pressing roller 36 and the heating roller 32, continues to be conveyed in close contact with the fixing film stretched between the heating roller 32 and the upper separation roller 34, before the portion reaches to the upper separation roller 34. The conveyer belt 37 supports the backside of the sheet P to maintain the close-contactness between the sheet P and the fixing film 24. During the conveyance process, the sheet of the soften/fused toner image Tb is radiated, by which a cooled/solidified toner image Tc is produced. The heat radiation in this radiation and cooling process is provided by the spontaneous radiation in this embodiment. However, a forced cooling may be employed with the use of a heat radiation fins or with the use of a fan.

When the portion reaches the upper separation roller 34, the fixing film 24 is deflected along the upper separation roller 34 having a large curvature away from the sheet P surface, by which the fixing film 24 and the sheet P are separated from each other. Then, the sheet P is conveyed to the discharging tray 12. By the time of the separation, the toner is sufficiently cooled and solidified, so that the adherence of the toner to the sheet P is sufficiently large, whereas the adherence to the fixing film 24 is very small, so that the separation between the fixing film 24 and the sheet P is performed substantially without toner offset to the fixing film 24.

According to this embodiment, the set temperature of the heater may be increased than in the conventional heating roller type fixing system. By the increase of the temperature, the fixing performance is enhanced. In addition, the tolerable temperature range of the heater is larger at the high temperature side, so that the temperature control system is easy.

In addition, when the toner images of different, particularly three or more different color toners are fixed together (color mixture), the toner can be fused at the high temperature, and therefore, the color mixture is good. In addition, since the toner is once fused, and the fused toner is cooled and solidified while being in contact with the fixing film, and thereafter, it is separated from the fixing film, then the surface of the toner image follows the surface property of the fixing film. Therefore, if the fixing film is given the smooth surface, the surface of the toner image Tc can be as glossy as a silver salt photograph.

By reducing the thickness of the fixing film 24, the heat accumulation in the fixing film can be prevented, by which the cooling efficiency of the toner image is improved. Where the fixing film is made of thin resin, the contactness with the toner image is improved, so that the heat transfer efficiency is further improved.

Figure 6:
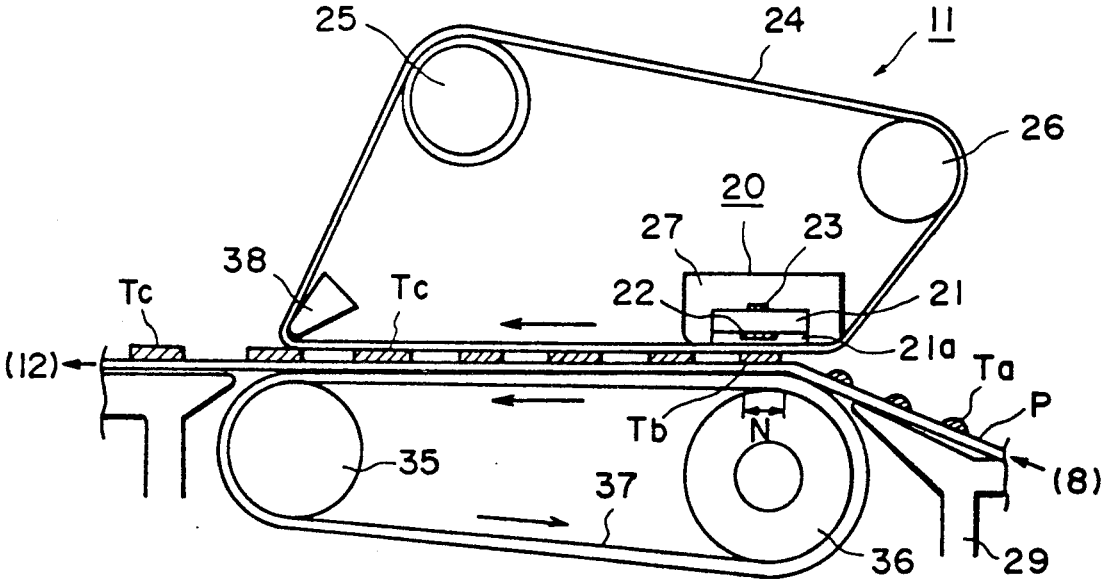

FIG. 6 shows a further embodiment.

The heater 32 is not limited to the form of the heating roller, but may be a fixed heater 20 of the first embodiment, as shown in FIG. 6. In this case, in addition to the above-described advantageous effects, the thermal capacities of the heat generating element 22 and the base plate 21 are small, and are thermally isolated, by which the temperature rising speed is high with the advantage of the elimination of the necessity of the stand-by temperature control.

In place of the upper separation roller 34, a separation stay 38 having a further large curvature edge may be disposed, by which the sheet P can be separated from the fixing film 24 with increased certainty.

Figure 7:
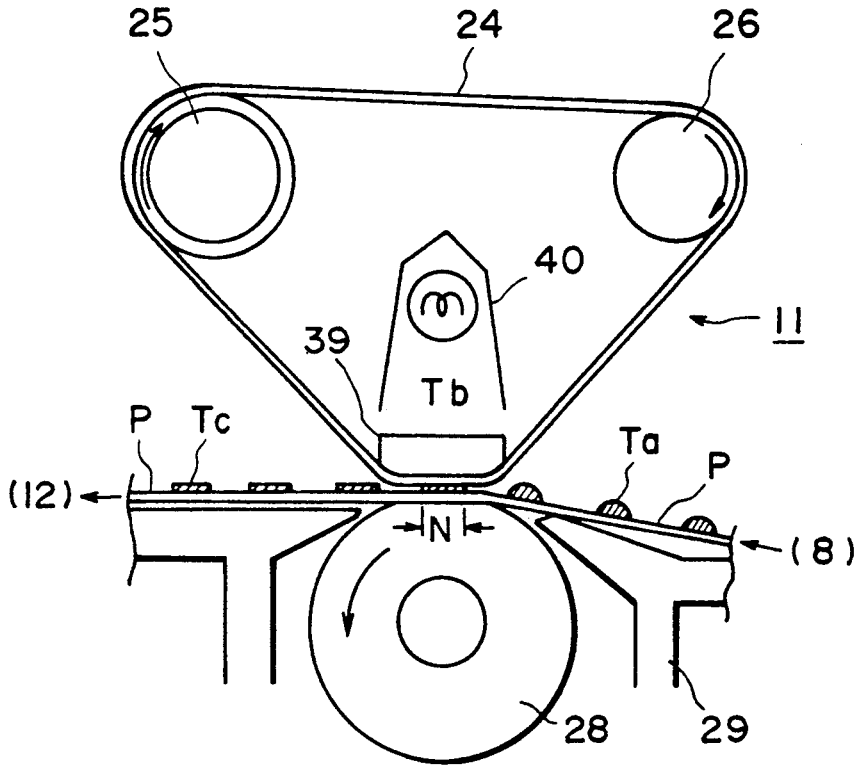

FIG. 7 shows an image fixing apparatus according to a yet further embodiment of the present invention.

In place of the heater 20 of the first embodiment (FIG. 1), a transparent member made of heat resistive glass or the like is disposed, through which the toner image is heated by a heat radiation source 40 such as halogen lamp disposed inside the endless fixing film 24.

In this embodiment, the fixing film 24 is preferably made of a material transparent to the wavelength of the radiation. Then, in this embodiment, the film 24 comprises, for example, heat-resistive layers 101 and 102 of polyimide resin containing the inorganic filler material (FIG. 3B) and a parting layer 103 made of transparent silicone resin.

In this embodiment, the radiation heating is employed, so that the toner can be heated and fused instantaneously. Therefore, the heating operation may be carried out only when the sheet P is at the nip N. Therefore, the power consumption can be reduced. In addition, the temperature rise in the apparatus is not significant.

In the embodiments of FIGS. 5, 6 and 7, too, the lateral shift control was smooth without the production of crease and without noise due to the sliding contact between the film and the heater.

As described in the foregoing, according to the present invention, the sliding between the film and the heater is remarkably improved so that the noise is not produced with the additional advantage of the easy control of the lateral shift of the film. Where the parting layer of the fluorinated resin is provided, the close-contactness between the film and the fluorinated resin layer is improved.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus, comprising:

a heater which is stationary in use; and a film movable in sliding contact with said heater at one surface of said film and movable in contact with a recording material at the other surface of said film, said film including a resin base layer in slidable contact with said heater and a surface fluorine resin layer formed on said resin base layer and contactable with the recording material, wherein said resin base layer comprises at least one of polyimide, polyether ether ketone, polyether sulfon and polyether imide resin material, and wherein fluorine resin particles are dispersed in said resin base layer.

2. An apparatus according to claim 1, wherein a content of the fluorine resin is 0.1–10 % by weight.

3. An apparatus according to claim 1, wherein the fluorine resin in the base layer and the fluorine resin of the surface fluorine resin layer are one of the same resin material.

4. An apparatus according to claim 1, wherein said heater extends in a direction perpendicular to a movement direction of said film and includes a heat generating resistor generating heat by electric power supply thereto.

5. An apparatus according to claim 1, wherein said film includes a heat generating resistor, wherein there is no air layer between the heat generating resistor and the image.

6. An apparatus according to claim 1, wherein said film is in a form of an endless belt.

7. An apparatus according to claim 6, further comprising a movable roller for controlling a position of said film in a direction perpendicular to a movement direction of said film.

8. An apparatus according to claim 1, wherein the image is an unfixed toner image.

9. An image fixing film, comprising:

a resin base layer comprising at least one of polyimide, polyether ether ketone, polyether sulfon and polyether imide resin material; and a surface fluorine resin layer on said base layer, wherein fluorine resin particles are dispersed in said resin base layer.

10. A film according to claim 9, wherein a content of the fluorine resin is 0.1–10 % weight.

11. A film according to claim 9, wherein the fluorine resin in the base layer and the fluorine resin of the surface layer are of the same resin material.

12. A film according to claim 9, wherein said film is in a form of an endless belt.

13. An apparatus according to claim 1 or 9, wherein said base layer is selected from the group consisting of polyimide, polyethen ether ketone, polyethen sulfone or polyethen imide.

14. An apparatus according to claim 1, wherein the fluorine resin particles are precipitated at both side surfaces of said base layer.

15. An apparatus according to claim 1, wherein a content of the fluorine resin particles is higher at a surface of said resin base layer than in the middle thereof.

16. An apparatus according to claim 9, wherein the fluorine resin particles are precipitated at both side surfaces of said base layer.

17. An apparatus according to claim 9, wherein a content of the fluorine resin particles is higher at a surface of said resin base layer than in the middle thereof.

* * * * *

UNITED STATES PATENT AND TRADEMARK OFFICE

CERTIFICATE OF CORRECTION

PATENT NO. : 5,309,210

DATED : May 3, 1994

INVENTOR(S) : AKIRA YAMAMOTO, ET AL.

It is certified that error appears in the above-indentified patent and that said Letters Patent is hereby corrected as shown below:

On title page, item [56] insert --5,043,763 8/1991 Koh et al.--; and "3,578,797 5/1991 Hodges" should read --3,578,797 5/1971 Hodges--.

--3,578,797 5/1971 Hodges".

On title page, item [75] "Hidekazu Muruta," should read --Hidekazu Maruta,".

Column 1,
line 53, "proposes" should read --propose--.

Column 2,
line 35, "view" should read --views--;
line 67, "constitute" should read --constitutes--.

Column 3,
line 1, "slid" should read --slit--.

Column 4,
line 4, "FIGURE" should read --Figure,--; and
line 60, "thermister" should read --thermistor--.

UNITED STATES PATENT AND TRADEMARK OFFICE

CERTIFICATE OF CORRECTION

PATENT NO. : 5,309,210

DATED : May 3, 1994

INVENTOR(S) : AKIRA YAMAMOTO, ET AL.

It is certified that error appears in the above-indentified patent and that said Letters Patent is hereby corrected as shown below:

Column 5,
line 34, "that" should read --than--.

Column 6,
line 3, "view" should read --views--.

Column 7,
line 14, "a" should be deleted; and
line 25, "a" (first occurrence) should be deleted.

Column 8,
line 2, "a heat" should read --heat--.

Column 10,
line 26, "weight." should read --by weight.--;
line 42, "An apparatus" should read --A film--; and
line 45, "An apparatus" should read --A film--.

Signed and Sealed this

Eighth Day of November, 1994

Bruce Lehman

*Attest:*

BRUCE LEHMAN

*Attesting Officer*

*Commissioner of Patents and Trademarks*